United States Patent [19]

Hoffman et al.

[11] 4,178,957

[45] Dec. 18, 1979

[54] DISHWASHER FILL SYSTEM

[75] Inventors: Robert E. Hoffman, Dayton; Richard B. Williams, Kettering; Carl J. Wright, Bellbrook, all of Ohio

[73] Assignee: White Consolidated Industries, Inc., Cleveland, Ohio

[21] Appl. No.: 962,060

[22] Filed: Nov. 20, 1978

[51] Int. Cl.[2] ..... F16K 21/18; D06F 39/08; B08B 3/02

[52] U.S. Cl. ..... 137/387; 137/389; 137/412; 137/624.18; 134/57 D; 200/84 R

[58] Field of Search ..... 137/387, 389, 412, 429, 137/624.18; 68/207; 239/251; 134/56 D, 57 D, 58 D; 200/84 R

[56] References Cited

U.S. PATENT DOCUMENTS

| | | | |
|---|---|---|---|
| 3,265,311 | 8/1966 | La Flame | 239/251 |
| 3,464,437 | 9/1969 | Zane | 137/387 |
| 3,610,271 | 10/1971 | Jarvis | 134/57 D X |
| 3,643,681 | 2/1972 | Simmons | 137/429 |
| 3,721,783 | 3/1973 | Hancock | 200/84 R |
| 3,829,636 | 8/1974 | Scott | 134/57 D X |
| 3,835,880 | 9/1974 | Hoffman et al. | 134/57 D X |
| 3,885,580 | 5/1975 | Cushing | 134/57 D |
| 3,894,555 | 7/1975 | Payne | 134/57 D X |
| 4,119,116 | 10/1978 | Johnson et al. | 137/387 |

*Primary Examiner*—Robert L. Bleutge

*Attorney, Agent, or Firm*—Pearne, Gordon, Sessions

[57] ABSTRACT

A dishwasher fill system providing a combination fill control system and timer fill sequence that assures a predetermined minimum quantity of water is present in the dishwashing chamber regardless of the water fill flow rate and the household waterline pressure. The system provides two assured fill levels with a predetermined minimum water level fill cycle portion for a rinse fill and an increased minimum level fill cycle portion for a wash fill. If the rinse fill water level is below its minimum quantity after a predetermined run time, first switch means will energize the timer motor and the fill valve will remain open until said rinse fill minimum level is reached. A fill sensor switch at this point will turn off the water valve and energize the timer motor. During wash fill portions of the cycle the system is as described above with the addition that second switch means will energize the timer motor and the water valve will remain open for a predetermined number of seconds longer than for the minimum fill cycle portion, thereby filling the chamber to its wash fill level.

2 Claims, 7 Drawing Figures

DISHWASHER FILL SYSTEM

This invention relates to domestic dishwashers and is directed to a dishwasher fill level control system which assures a predetermined minimum quantity of water being present in the washing chamber during both the rinse and wash fill cycle portions. Dishwashers having combined time and fill level control systems which assure a proper fill level throughout a wide range of reasonably available domestic water supply pressures are well known in the prior art. The U.S. Pat. No. 3,835,880 to Robert E. Hoffman and Carl J. Wright discloses a system incorporating a continuously running timer during fill together with a timer controlled fill switch connected in series with the pressure actuated water level switch. The pressure switch controls fill when the dishwasher is supplied with water in normal supply pressures and guards against floods occasioned by a clogged drain and malfunctioning timed water level switches. The timer controls fill to advance the cycle by shunting the pressure switch when the dishwasher is supplied with water at unreasonably low supply pressures.

It is an object of the present invention to provide an improved time and fill level control system for a domestic dishwasher for assuring a predetermined miminum rinse fills and increased minimum wash fills for a dishwasher having a sump for containing the levels including fill valve means adapted for normally supplying the wash and rinse fills from a domestic supply of water available in varying line pressures and a timer for controlling the fill valve means in a dishwashing cycle including sequential fill cycle portions for the rinse and wash fills. The timer includes a timer motor and a timer motor switch operable for selectively energizing and deenergizing the timer motor during either of the cycle portions to advance the dishwashing cycle through the cycle portions. The system further includes rinse fill and wash fill timer switches and a rinse level switch responsive to the water level in the sump. The timer motor switch and the rinse fill timer switch are adapted during either of the cycle portions to supply power for energizing the timer motor and being in shunt relation to each other so that the rinse fill timer switch may supply such power when the timer motor switch does not. Further, the rinse level switch is in series circuit relation with the rinse fill timer switch while having a first position in series circuit relation with the fill valve means for energizing the same when the water in the sump is below the rinse level. The rinse level switch moves to a second position for deenergizing the fill valve means when water in the sump is at the minimum rinse fill level, thereby assuring the rinse level irrespective of the water line pressures and the operation of the timer motor switch. The system further assures the advance of the dishwashing cycle when the rinse fill level has been assured.

A further object of the fill system set forth in the foregoing object is the provision of a float assembly in the sump including float means adapted to float adjacent the surface of the liquid, and first and second float switch means electrically connected to the dishwasher circuit means wherein the float means is adapted to switch the first switch from a first position to a second position upon the float completing its vertically upward movement from a lowermost rest position to a first minimum rinse fill level in response to liquid filling the sump during the energization of the fill valve. The float is further adapted to switch the second switch means and deenergize the fill valve upon the float attaining a third liquid overflow level.

Further objects and advantages of the present invention will be apparent from the following description, reference being had to the accompanying drawing wherein a preferred embodiment of the present invention is clearly shown.

Figure 1:
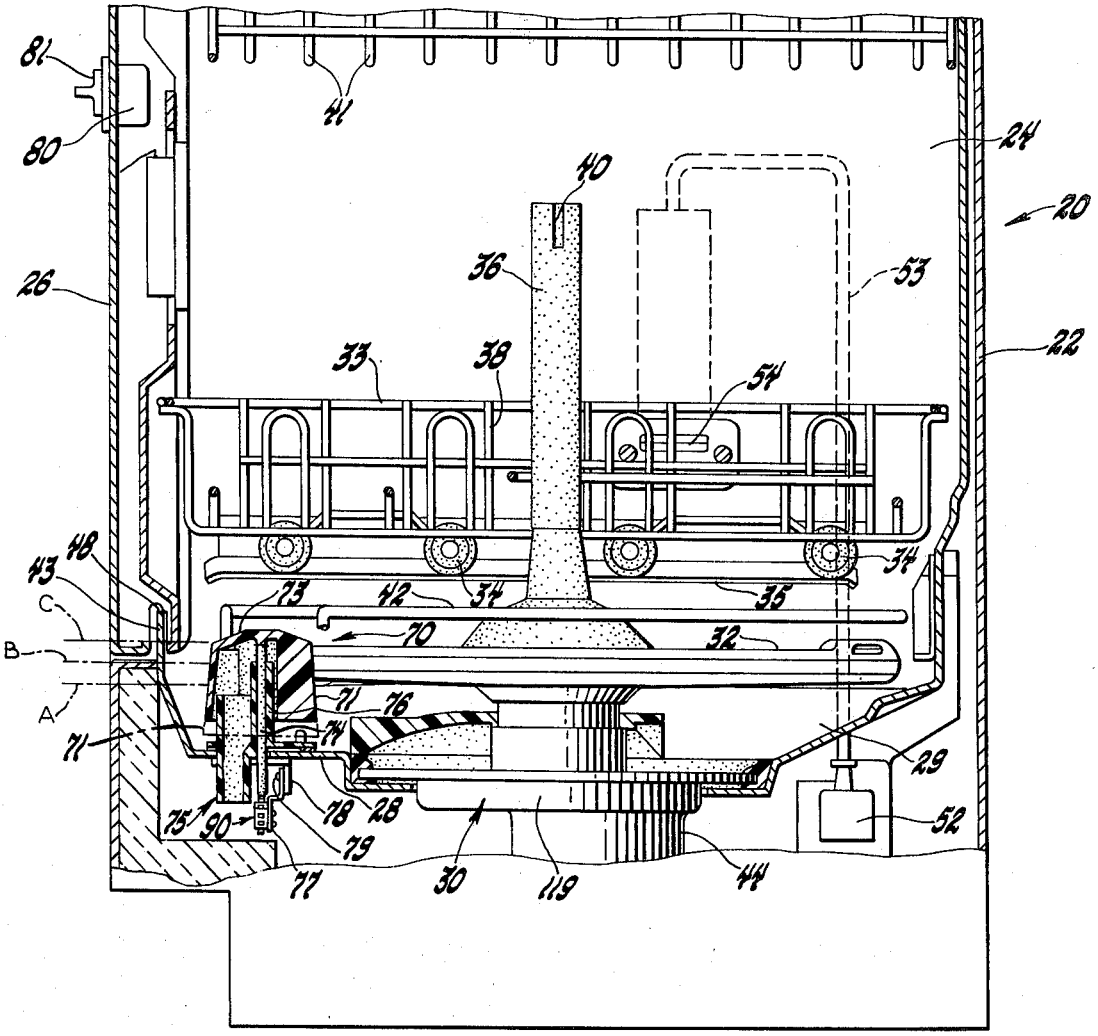
FIG. 1 is a fragmentary elevational view of a dishwasher with portions broken away, to show the general location of the switching arrangement of the present invention.

For the purpose of illustrating one application of the present invention, there is shown in FIG. 1 a portion of a dishwasher illustrated generally at 20. The dishwasher 20 is comprised of casing means 22 defining a dishwashing chamber 24 closed at the front thereof by dishwasher door 26 and having a bottom wall 28 forming a depressed tub sump or liquid container 29 leading to a pump motor assembly 30 which may be of the type taught in U.S. Pat. No. 3,265,311, issued Aug. 9, 1966.

In general, the water distribution system includes a revolvable spray arm 32 beneath the lower rack 33 supported on rollers 34 operating on a track 35. A rotating spray column or spray tube 36 is affixed to the spray arm and extends upwardly through a guard portion 38 of the lower rack. The spray tube has an outlet 40 adapted to project a spray generally upwardly through the support wire network of an upper dishrack 41. A reversible motor 44 in the pump motor assembly 30 directly drives the pump in one direction to recirculate the water for washing or rinsing, and, when reversed pumps the water to drain. A heater 42 provides recovery heat to the wash and rinse water for adding heat to the chamber for the drying cycle.

The dishwasher sump 29 is sized to contain predetermined minimum quantities of water during the rinse and wash cycles. In the proposed dishwasher wash system, two fill levels are required. The sump 29 contains a minimum of about 2.1 gallons of water standing in a quiescent state at a normal rinse fill level for rinse periods or cycles indicated by the dot-dash line A in FIG. 1. The sump 29 contains a minimum of about 2.6 gallons of water for a normal wash level for wash periods or cycles indicated by the dot-dash line B in FIG. 1. An overfill level for the sump is indicated by the dot-dash line C in FIG. 1 positioned below the sump's raised ledge or wall 43 which defines along its upper edge 48 the sump's maximum or overflow level.

Water is supplied to the sump 29 by means of a solenoid actuated water fill valve 52 which controls the flow of liquid through supply pipe 53 and then through an opening 54 in the dishwashing chamber 24 to the sump 29 of the dishwasher. Specification for the fill valve 52 calls for a supply of water at a rate of about 1.5 gallons per minute from a domestic water supply having supply pressures between 20 pounds per square inch (psi) and 120 psi.

Located in the sump 29 is a suitable water level control device which in the disclosed embodiment is a float assembly 70 including float means adapted to float adjacent the surface of the liquid. In the form shown the float means is a float 71 in the general form of an inverted cup which may be molded from a suitable lightweight plastic material. The float 71 is disclosed in copending U.S. Pat. application Ser. No. 853,318 to Woolley, et al, and reference may be had to that disclosure for details thereof. The float includes a closed top wall 73, a downwardly facing open bottom with a downwardly extending elongated central control actuating rod or stem 74 located on the principal axis of the float.

A float support, generally indicated at 75, includes a central sleeve 76 having a vertically extending bore therethrough dimensioned for slidable reception of the stem 74. A switch mounting bracket 77 is suitably secured to a lower portion 78 of the float support as by screws 79. The bracket 77 supports a pair of switch means 90 in the form of a first fill sensor switch 91 and a second float switch 92. In the disclosed embodiment the switch 91 is a sensitive microswitch of the single throw-double pole type having its movable contact 93 connected to timer contact "two."

The switch 91 is provided with an operating plunger or button 94 preferably spring biased upwardly against an operating lever or arm 91′ extending in a lefthand direction (FIG. 2) over the top of the button 94 and laterally across the axis of the stem 74. In the disclosed embodiment the switch 92 is also a sensitive microswitch of the single throw-single pole type with its fixed contact 96′ connected to one side of fill valve solenoid 113 and its movable contact 96 connected via lines 97 and 95 to upper first fixed contact 98 of the fill sensor switch 91. The switch 92 is provided with an operating plunger or button 100 preferably spring biased upwardly against an operating arm 92′ extending in a righthand direction (FIG. 2) over the top of the button 100 and laterally across the axis of the stem 74.

Figure 2:
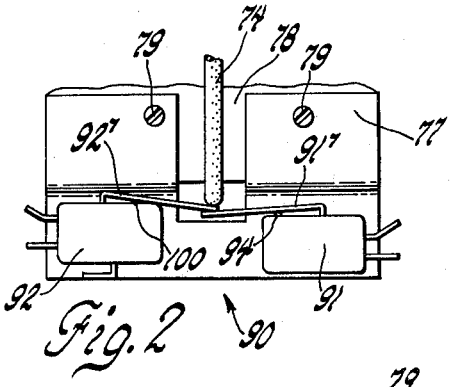
FIG. 2 is an enlarged fragmentary partially schematic view of the switch means showing a first position prior to the water fill.
Figure 3:
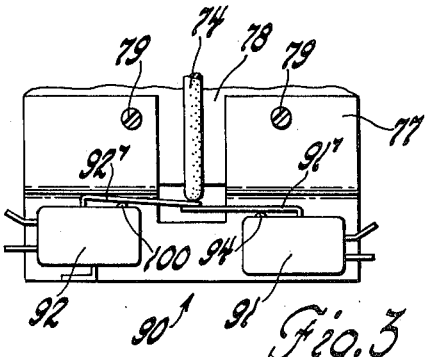
FIG. 3 is a view similar to FIG. 2, showing the switch means at its minimum fill position.
Figure 4:
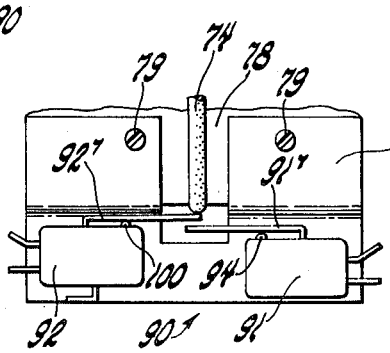
FIG. 4 is a view similar to FIG. 3, showing the switch means in its overfill position.

As seen in the switching sequence of FIGS. 2, 3 and 4 prior to water entering the sump 29, the switch means is as shown in FIG. 2 wherein the float 71 is at its lowermost or rest position, shown by dashed lines in FIG. 1. With the float 71 at its lowermost position the lower free end of stem 74 contacts the free end of arm 92′ which, by virtue of its overlying position relative to arm 91′, engages arm 91′ such that both switch plungers 94 and 100 are depressed. In this FIG. 2 position depressed plunger 94 causes switch 91 to have its movable contact 93 switched to contact its upper fixed contact 98 as shown in FIG. 5, while depressed plunger 100 causes normally open switch 92 to have its movable contact 96 switched to contact its fixed contact 96′.

It is a desirable feature of a dishwasher fill system to insure a predetermined amount of water being present in the wash chamber or tub during wash and rinse cycles. This is true because a certain minimum quantity of water is required to insure proper washing of dishes. The present invention provides a fill control system utilizing the timer fill sequence for assuring that such a minimum quantity of water is present in the dishwasher regardless of the water fill flow rate and line pressure.

In the disclosed embodiment for a dishwasher wash system, two minimum fill levels are required. A first minimum low fill, indicated by construction line "A" in FIG. 1, is required for rinse fill cycle portions. In the form shown low fill level "A" indicates a fill of about 2.1 gallons in the sump. A second minimum high fill level, indicated by construction line "B" in FIG. 1, is required for wash fill cycle portions. In the form shown a high fill level "B" provides about 2.6 gallons of water for wash periods depending upon the existent rate of water flow supplied to the dishwasher from a municipal water system.

Figure 5:
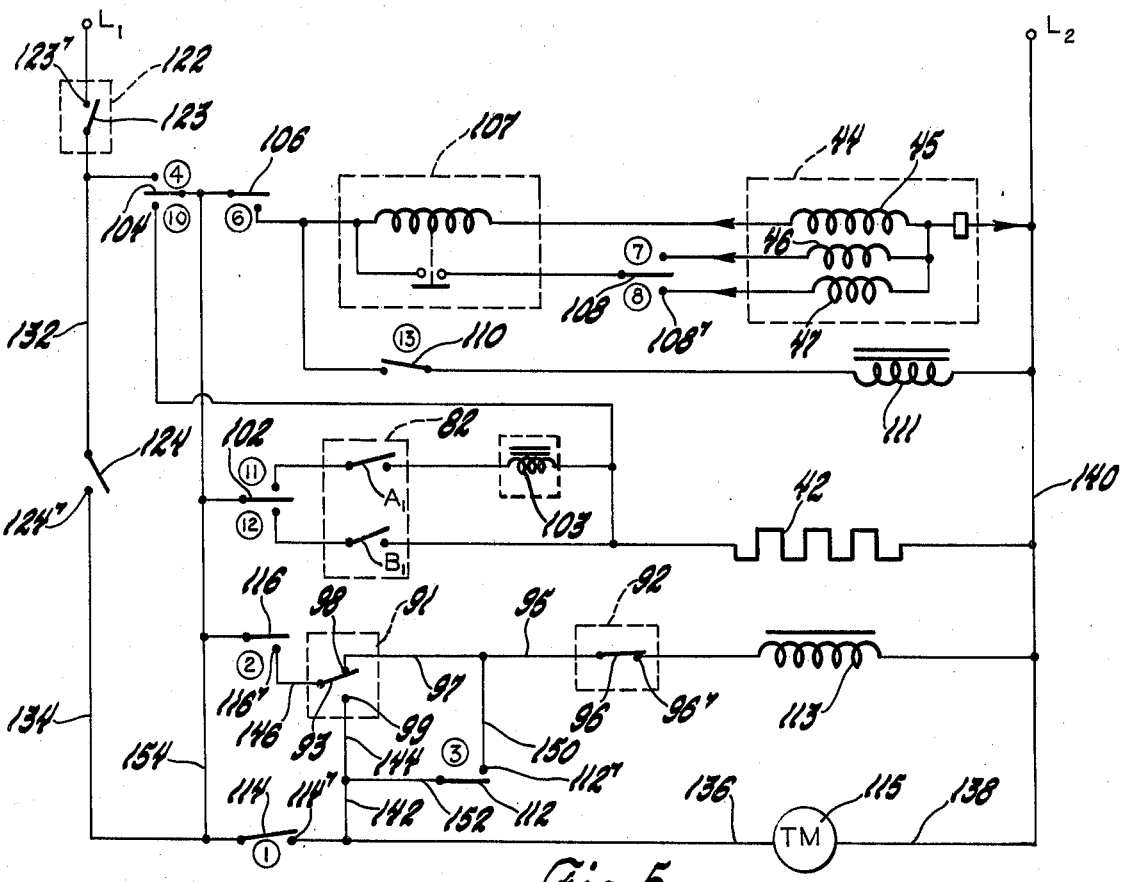
FIG. 5 is a schematic wiring diagram for operating the dishwasher of FIG. 1 and including a circuit arrangement in accordance with the present invention.

In accordance with FIG. 5, it should be understood that the various internal switches $A_1$ and $B_1$ within the dashed outline of option selector switch 82 are moved by their associated buttons (not shown) to a position opposite that indicated when the rinse and hold option button or the heater option button is selected as, for example, by being depressed.

The timer contacts are shown encircled in FIG. 5. Thus, timer 80 (FIG. 1) includes movable switch 102 operating between water conditioner solenoid 103 timer contact "eleven" and heater 42 timer contact "twelve"; movable switch 104 operating between a line contact "four" and a heater timer contact "ten"; movable switch 106 operating to open and close timer contact "six" for motor starting relay 107; movable switch 108 operating between motor phase-wash winding 46 timer contact "seven" and motor phase-drain winding 47 timer contact "eight"; movable switch 110 operative to open and close detergent dispenser solenoid 111 timer contact "thirteen"; movable switch 112 operative to open and close fill valve solenoid 113 timer contact "three"; movable switch 114 operative to open and close timer motor 115 timer contact "one"; and movable switch 116 operative to open and close fill valve solenoid 113 timer contact "two".

The reversible motor 44 main winding 45 directly drives pump 119 in one direction by means of wash winding 46 being energized to recirculate the water for washing or rinsing. When the motor 44 is reversed by means of drain winding 47 being energized the motor 44 pumps the water to drain.

The invention will be described in connection with the fill system accompanying the selection of a rinse fill cycle beginning with chart line O on the timer cycle chart of FIG. 6 and terminating at chart line 1. The dishwashing rinse cycle is initiated through door switch 122 movable contact 123 which closes to its fixed contact 123′ when the door 26 is closed. Upon timer knob 81 (FIG. 1) being rotated to its start position and pushed-in, a push-pull switch 124 is closed to its fixed contact 124′. With movable switch 114 of timer contact "one" closed to its fixed contact 114′ at chart line O, timer motor 115 is energized from $L_1$, closed door switch 122, line 132 closed push-pull switch 124, line 134 closed timer contact "one" switch 114 closed to its contact 114′ line 136, timer motor 115, lines 138 and 140 to the $L_2$ side of the power source. At first, pump motor 44 will be operated in the drain direction with movable switch 108 closed to fixed contact 108′ of timer contact "eight" for purging the sump of stagnant water. At the FIG. 6 cycle chart line O movable switch 116 closes to its fixed contact 116′ at timer contact "two" to energize water valve solenoid 113 through water level float switch 92 having its movable switch 96 closed to its fixed contact 96′.

Figure 6:
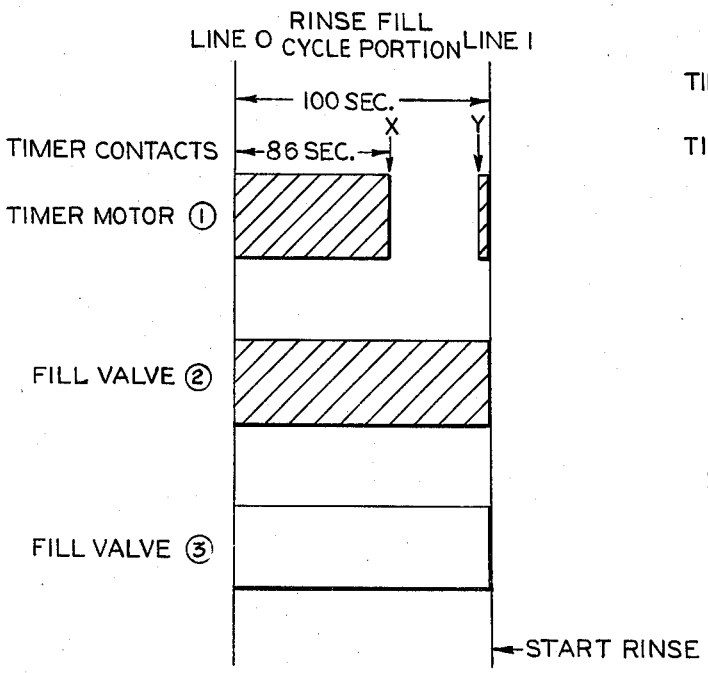
FIGS. 6 and 7 are timer cycle charts showing the functional relationships of certain of the timer contacts of FIG. 5.

For the rinse fill cycle portion of FIG. 6 it will be noted that the time duration between lines O and 1 for the timer represents a predetermined timer interval which in the disclosed form is a 100 second timer impulse achieved by a commercially available escapement timer. At the beginning of a typical low fill period, timer contacts "one" and "two" are closed at line O thereby energizing the timer motor 115 through timer contact "one" and the water valve through timer contact "two" as explained above. The fill sensor switch movable contact 93 is set to transfer from fixed contact 98 to fixed contact 99 at a water fill level "A" of about 2.1 gallons of water in the dishwasher tub. Line "X" on the chart of FIG. 6 indicates the point at which the timer contact "one" opens which, in the disclosed form, is about 86 seconds after the start of the impulse at line O. At normal or design water fill rates approximately 2.1 gallons of water will have been filled in the dishwasher sump 29 at timer chart line "X". At this time the fill valve solenoid 113 will be deenergized while the timer motor 115 will continue to run to line 1 of the FIG. 6 chart via conductors 136, 142 and 144; fixed contact 99 contacting movable contact 93, line 146 and the movable switch 116 closed to its fixed contact 116' of closed timer contact "two".

If, however, at time "X" the sump water level is below level "A" the movable contact 93 will remain in the position shown in FIG. 5 resulting in the fill valve solenoid 112 remaining energized through closed timer contact "two" while the timer motor 115 is deenergized until the fill level "A" is reached regardless of the time required to reach level "A". The fill sensor switch movable contact 93 will then move to its fixed contact 99 deenergizing the water valve solenoid 113 and energizing the timer motor 115 causing it to advance to line 1 and thus complete the low or rinse fill cycle portion. It will be noted that timer contact "one" (timer motor) must be closed at point "Y" on the timer sequence chart of FIG. 6 before timer switch contact "two" (fill valve) is opened.

Figure 7:
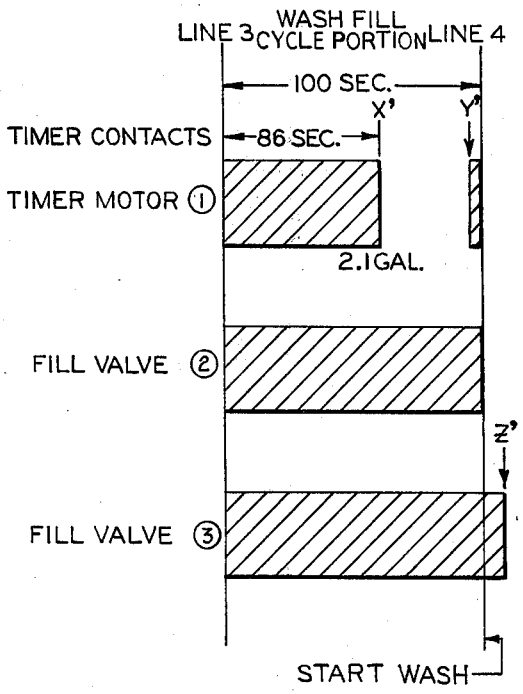

Turning now to the timer chart of FIG. 7, a portion of a timer chart is shown for a high or wash fill cycle portion which in the disclosed form is indicated by sump liquid level "B" in FIG. 1. During a high fill cycle portion, indicating an impulse starting at line 3 of FIG. 7, the initial operation of the system is the same as described above for the low fill with the exception that timer contact "three" (fill valve) is shown closed. Thus, at point "X" on the chart of FIG. 7 the low water level "A" is achieved in identical manner to point "X" of chart 6. Between points X' and Y' the water valve solenoid 113 is now energized via the closed float switch 92 conductors 95 and 150, movable switch 112 closed to its fixed contact 112' at timer contact "three" (fill valve), conductors 152, 144; fixed contact movable switch 93 closed to its fixed contact 99 of the fill sensor switch 91, and movable switch 116 closed to its fixed contact 116' at timer contact "two" (fill valve) conductors 154, 134, closed switch 124, line 132 and closed switch 122 to the $L_1$ side of the power source. It will be noted again that the timer contact "one" (timer motor) must be closed at point Y' on timer sequence chart of FIG. 7 before the timer switch contact "two" (fill valve) is opened.

The result is that the water valve solenoid 113 remains energized for a predetermined extended length of time. In the disclosed form the extended time is of the order of about 20 seconds indicated from points X' to Z' on the chart of FIG. 7. The volume of additional water supplied to the sump during this extended time to line Z' will depend upon the particular water fill flow rate available. A normal or customary flow rate will result in the water level reaching line "B" in FIG. 1, which for the disclosed high fill of the disclosed embodiment is about 2.6 gallons of water.

While the embodiment of the present invention as herein disclosed constitutes a preferred form, it is to be understood that other forms might be adopted.

The embodiments of the invention in which an exclusive property or privilege is claimed are defined as follows:

1. A water fill and cycle advance system for assuring a predetermined lesser rinse level of water and a greater wash level of water for a dishwasher having a sump for containing said levels, fill valve means adapted for normally supplying the wash level and rinse level of water from a domestic supply of water available at varying line pressures and a timer for controlling said fill valve means in a dishwashing cycle including sequential fill cycle portions for rinse fill and wash fill, said timer including a timer motor and a timer motor switch operable for selectively energizing and deenergizing the timer motor during either of said cycle portions to advance said dishwashing cycle through said cycle portions, said system including rinse fill and wash fill timer switches and a rinse level switch responsive to water level in said sump, said timer motor switch and said rinse fill timer switch adapted during either of said cycle portions to supply power for energizing said timer motor and being in shunt relation to each other so that said rinse fill timer switch may supply such power when said timer motor switch does not, said rinse level switch being in series circuit relation with said rinse fill timer switch and having a first position in series circuit relation with said fill valve means for energizing said fill valve means when water in said sump is below said rinse level and movable to a second position in series circuit relation with said timer motor for deenergizing said fill valve means when water in said sump is at said rinse fill level and for reenergizing said timer motor through said rinse fill timer switch to advance said dishwashing cycle through either of said cycle portions after said timer motor switch has been selectively operated for deenergizing said timer motor, thereby assuring said rinse level irrespective of said line pressure and the operation of said timer motor switch and further assuring the advance of said dishwashing cycle when said rinse fill level has been assured, said wash fill timer switch being in series circuit relation with said fill valve means and in shunt with said rinse fill timer switch and said rinse level switch in its first position for energizing said fill valve means when water in said sump is above said rinse fill level, said wash fill timer switch being operable to supply power for energizing said fill valve means during said fill cycle portion for wash fill and inoperable to supply power for energizing said fill valve means during said fill cycle portion for rinse fill, thereby to supply less water for rinse during the fill cycle portion for rinse fill than for wash during the fill cycle portion for wash fill.

2. A water fill, flood prevention and cycle advance system for assuring a predetermined lesser rinse level of water and a greater wash level of water for a dishwasher having a sump for containing said levels to an overflow level, fill valve means adapted for normally supplying the wash level and rinse level of water to levels less than said overflow level from a domestic supply of water available at varying line pressures and a timer for controlling said fill valve means in a dishwashing cycle including sequential fill cycle portions for rinse fill and wash fill, said timer including a timer motor and a timer motor switch operable for selectively energizing and deenergizing the timer motor during either of said cycle portions to advance said dishwashing cycle through said cycle portions, said system including rinse fill and wash fill timer switches, a rinse level switch responsive to water level in said sump and an overflow switch responsive to said overflow level, said timer motor switch and said rinse fill timer switch adapted during either of said cycle portions to supply power for energizing said timer motor and being in shunt relation to each other so that said rinse fill timer switch may supply such power when said timer motor switch does not, said rinse level switch being in series circuit relation with said rinse fill timer switch and having a first position in series circuit relation with said overflow switch and said fill valve means for energizing said fill valve means when water in said sump is below said rinse level and movable to a second position in series circuit relation with said timer motor for deenergizing said fill valve means when water in said sump is at said rinse fill level and for re-energizing said timer motor through said rinse fill timer switch to advance said dishwashing cycle through either of said cycle portions after said timer motor switch has been selectively operated for deenergizing said timer motor, thereby assuring said rinse level irrespective of said line pressure and the operation of said timer motor switch and further assuring the advance of said dishwashing cycle when said rinse fill level has been assured, said wash fill timer switch being in series circuit relation with said overflow switch and said fill valve means and in shunt with said rinse fill timer switch and said rinse level switch in its first position for energizing said fill valve means when water in said sump is below said overflow level and above said rinse fill level, said wash fill timer switch being operable to supply power for energizing said fill valve means during said fill cycle portion for wash fill and inoperable to supply power for energizing said fill valve means during said fill cycle portion for rinse fill, thereby to supply less water for rinse during the fill cycle portion for rinse fill than for wash during the fill cycle portion for wash fill, said overflow switch being closed when said sump contains either said wash fill level or said rinse fill level of water and being operable to deenergize said fill valve means and terminate the supply of water to said sump when the level of water in said sump reaches an abnormal overflow level irrespective of the operation of said timer switches or said rinse fill level switch.

* * * * *